US008157417B2

(12) United States Patent
Chen

(10) Patent No.: US 8,157,417 B2
(45) Date of Patent: Apr. 17, 2012

(54) FOCUSED LIGHTING DEVICE

(75) Inventor: Tony K. T. Chen, Dasi Township (TW)

(73) Assignee: Quarton, Inc. (TW)

( * ) Notice: Subject to any disclaimer, the term of this patent is extended or adjusted under 35 U.S.C. 154(b) by 166 days.

(21) Appl. No.: 12/799,400

(22) Filed: Apr. 22, 2010

(65) Prior Publication Data

US 2011/0103057 A1 May 5, 2011

(30) Foreign Application Priority Data

Nov. 3, 2009 (TW) ..... 98137235 A

(51) Int. Cl.
*F21V 14/00* (2006.01)

(52) U.S. Cl. ..... 362/256; 362/241; 362/245; 362/240

(58) Field of Classification Search ..... 362/254, 362/255, 256, 241, 243, 245, 240
See application file for complete search history.

(56) References Cited

U.S. PATENT DOCUMENTS 6,106,137 A * 8/2000 Adams et al. ..... 362/237
6,485,160 B1 * 11/2002 Sommers et al. ..... 362/184
6,767,111 B1 * 7/2004 Lai ..... 362/240
6,796,698 B2 * 9/2004 Sommers et al. ..... 362/555
6,814,470 B2 * 11/2004 Rizkin et al. ..... 362/327
7,011,432 B2 3/2006 Chen et al.
7,186,010 B2 * 3/2007 Coushaine et al. ..... 362/547
D544,972 S * 6/2007 Coushaine ..... D26/37
7,281,818 B2 * 10/2007 You et al. ..... 362/241
7,524,083 B2 * 4/2009 Sandoval ..... 362/221
7,566,154 B2 * 7/2009 Gloisten et al. ..... 362/545

* cited by examiner

*Primary Examiner* — Ali Alavi
(74) *Attorney, Agent, or Firm* — Raymond Sun

(57) ABSTRACT

A focused lighting device has a plurality of light sources, each of which emits a light beam, and a focusing cup. The cup has a cup body with an opening at its top, a reflective hood positioned in the cup body and defining a plurality of reflective mirrors, with each mirror corresponding to a separate one of the light beams emitted from the light sources to reflect the corresponding light beam emitted from the light sources, so as to simulate a central light source focused in the focused cup. The focused lighting device can also include a plurality of partitions, with each partition positioned between adjacent reflective mirrors to separate the light beams emitted from the light sources so as to prevent the light beams from projecting onto non-corresponding reflective mirrors. The focused lighting device can further include a hood body disposed at the top opening of the focusing cup and having a plurality of parallel light guides.

20 Claims, 9 Drawing Sheets

FOCUSED LIGHTING DEVICE

BACKGROUND OF THE INVENTION

1. Field of the Invention

The present invention relates to a focused lighting device, and in particular, to a focused lighting device which uses partitions or light guides disposed on its hood body to significantly reduce or homogenize light beams other than main light beams.

2. Description of the Related Art

With today's improving technology, people's lives are becoming more convenient and comfortable everyday, and lighting is indispensable to our daily lives. Conventional bulbs use filaments to generate light; for example, filament made of tungsten wires is connected to a circuit to become a point light source and emits light from the center. This type of bulb consumes significant energy and generates a large amount of heat, as well as having a short service life. To overcome these drawbacks, light emitted diodes (LEDs) have been developed for use as light sources.

The LEDs that are available in the market are usually made by placing LED chips on the center of a base and then packaging by epoxy resin or silicone externally. The top of the packaging is slightly curved to act as a convex lens, which enables the light generated from the chip to be refracted with a predetermined projection angle.

LEDs are characterized by low power consumption and long service life. However, when the intensity of a single LED light source is increased, the light-emitting area increases as a result, so that the existing optical focusing system cannot project the main light beam at a small angle. For this reason, if a plurality of LEDs is used for projection, a single optical system cannot be used to project the light beams emitted from a plurality of LEDs into a small-angle main light beam.

Consequently, to meet such a need, a Republic of China patent (ROC Pat. No. 5495570) and a United States patent (U.S. Pat. No. 7,011,432) disclose a device in which a plurality of LEDs are correspondingly arranged on a reflective hood having a plurality of reflective mirrors, and the light beams emitted from the LEDs are projected outwardly through the reflective mirrors of the reflective hood. This design simulates a plurality of light sources as a center light source to project light outwardly, so as to overcome the difficulty in enhancing the projection intensity of the LEDs. However, the center light source formed by simulating a plurality of LEDs cannot project all the emitted light to the corresponding reflective mirrors; rather, some light beams will be projected on to other reflective mirrors in addition to their corresponding reflective mirrors, thereby forming a secondary stray-light ring around the main light beam, which degrades the lighting quality and affects the application of the simulated center light source on the lighting devices.

SUMMARY OF THE INVENTION

The present invention provides a focused lighting device that has a plurality of light sources, each of which emits a light beam, and a focusing cup. The cup has a cup body with an opening at its top, a reflective hood positioned in the cup body and defining a plurality of reflective mirrors, with each mirror corresponding to a separate one of the light beams emitted from the light sources to reflect the corresponding light beam emitted from the light sources, so as to simulate a central light source focused in the focused cup.

The focused lighting device can also include a plurality of partitions, with each partition positioned between adjacent reflective mirrors to separate the light beams emitted from the light sources so as to prevent the light beams from projecting onto non-corresponding reflective mirrors.

The focused lighting device can further include a hood body disposed at the top opening of the focusing cup and having a plurality of parallel light guides such that the light beams emitted from predetermined angles with respect to the light guides are projected directly through the light guides, and the light beams emitted from other angles with respect to the light guides are reduced or scattered by the walls of the light guides.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
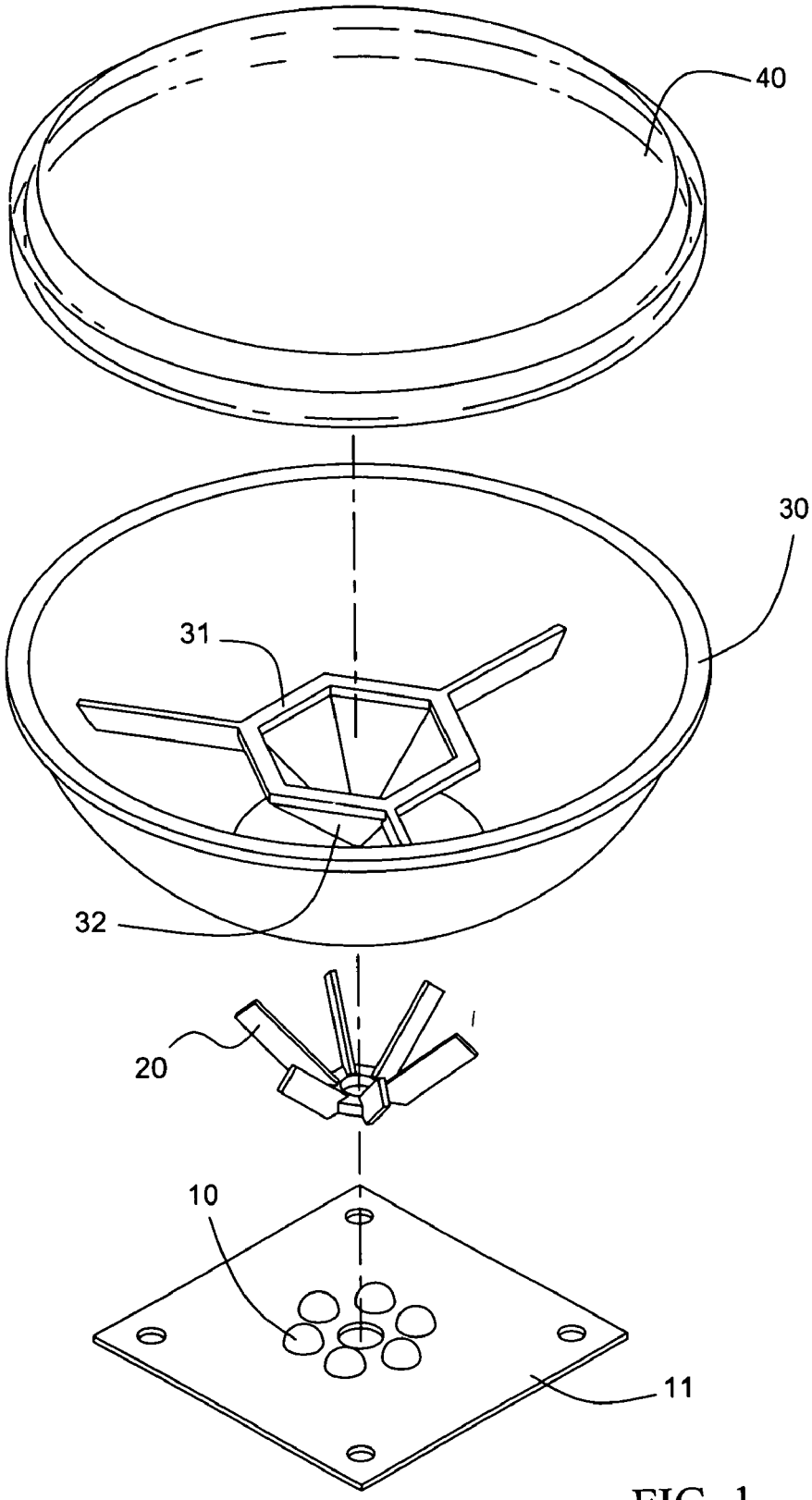
FIG. 1 is an exploded perspective view of a focused lighting device according to a first embodiment of the present invention.

FIG. 1 shows a focused lighting device according to a first embodiment of the present invention. The focused lighting device includes a hood body 40, a focusing cup 30, a plurality of partitions 20, and a plurality of light sources 10. The hood body 40 is disposed at the top opening of the focusing cup 30, which has a convex-like or hemispherical cup shape. A reflective hood 31 is centered at the bottom of the focusing cup 30. The reflective hood 31 has a plurality of reflective mirrors 32 arranged in a ring-like manner, and angled with respect to the horizontal plane, so that the bottom of the reflective hood 31 forms an apex. The bottom apex of the reflective hood 31 is disposed on a base plate 11 upon which a plurality of light sources 10 (e.g., LEDs) are arranged in a ring-like or polygonal arrangement with the LEDs arranged at the same planar level. In addition, the plurality of light sources 10 can also be arranged at different vertical or planar levels; for example a first plurality of LEDs can be arranged at a lower level, a second plurality of LEDs can be arranged at a second higher level, and so on. Each reflective mirror 32 is adapted to reflect a light beam emitted from one of the light sources 10, and each reflective mirror 32 is angled with respect to the light beam emitted from its corresponding light source 10 such that each respective light beam emitted from the respective light sources 10 can be reflected to the cup 30 via the corresponding reflective mirrors 32, thereby allowing the light sources 10 to simulate a central light source focused in the focusing cup 30. The reflective mirrors 32 may have a planar or curved surface to achieve different simulating results. For example, when the distance between the simulated central light source and the reflective mirrors 32 is desired to be equal to that between the light sources 10 and the reflective mirrors 32, then planar reflective mirrors 32 should be used. As another example, when the distance between the simulated central light source and the reflective mirrors 32 is desired to be smaller than that between the light sources 10 and the reflective mirrors 32, then curved reflective mirrors 32 should be used.

Figure 2:
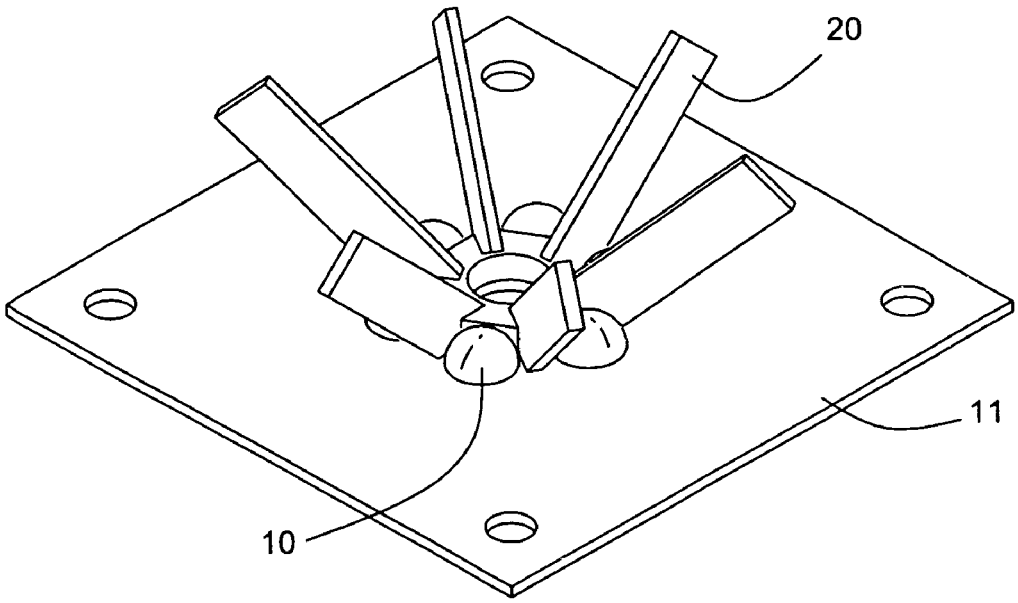
FIG. 2 is a partial close-up perspective view of the partition and light source of the focused lighting device of FIG. 1.
Figure 3:
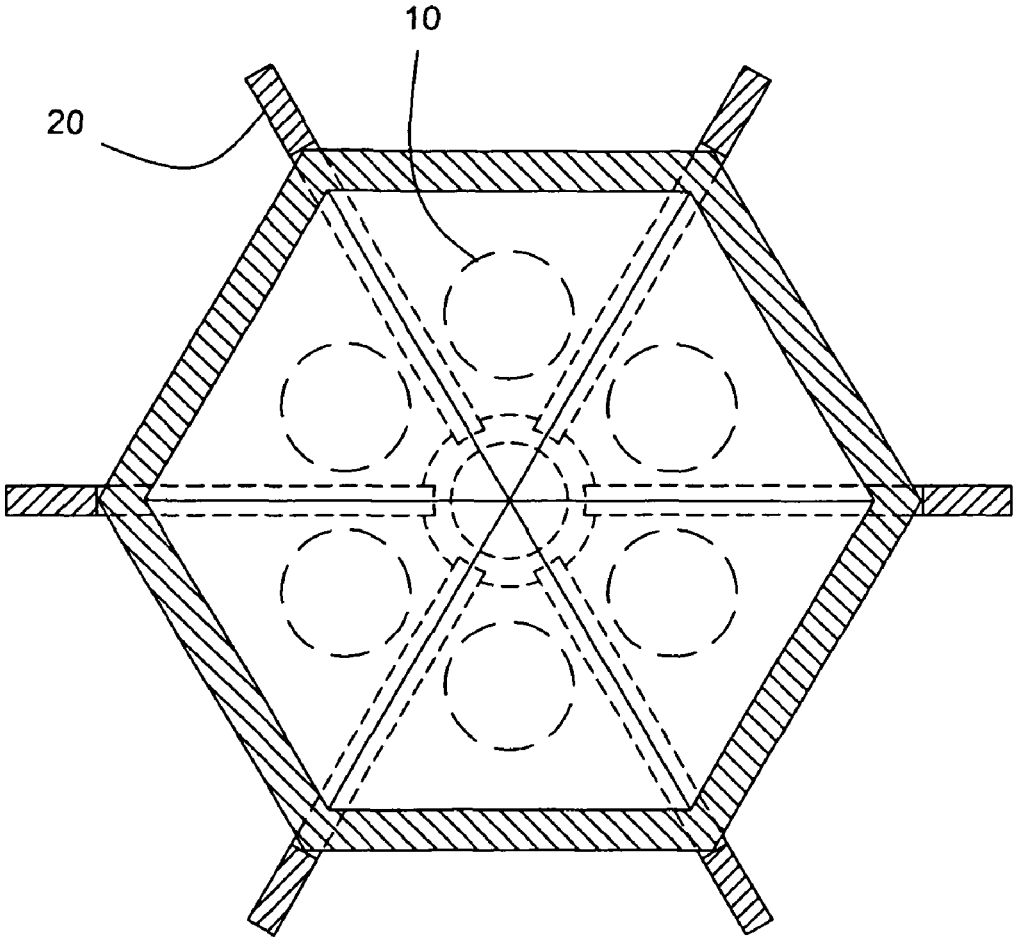
FIG. 3 is a top plan view of the focused lighting device of FIG. 1.

Further, the plurality of partitions 20 are disposed between adjacent reflective mirrors 32 on the side of the light sources 10 corresponding to the reflective hood 31. The partitions 20 are sized and configured to separate the light beams emitted from the light sources 10 and to prevent the light beams emitted from the light sources 10 from projecting onto any non-corresponding reflective mirrors 32. FIGS. 2-3 illustrate the relationship between the partitions 20, the reflective mirrors 32 and the light sources 10. The partitions 20 are individually disposed between adjoining reflective mirrors 32 and individually separate the light sources 10 such that the light beams projected onto the partitions 20 will be scattered, diffused, or absorbed, and thus homogenized or reduced. Also, the light beams emitted from the light sources 10 are prevented from projecting onto the non-corresponding reflective mirrors 32 to form stray light other than the main light beams. Further, if the partitions 20 are made of materials with light-absorbing characteristics (e.g., dark acrylic or plastics), the partitions 20 can absorb the light beams projected onto the partitions 20 so as to reduce stray light beams other than the main light beams. If the partitions 20 are made of materials with light-scattering characteristics (e.g., light color or translucent acrylic or plastics), the partitions 20 can scatter and homogenize stray light beams other than the main light beams.

Figure 4:
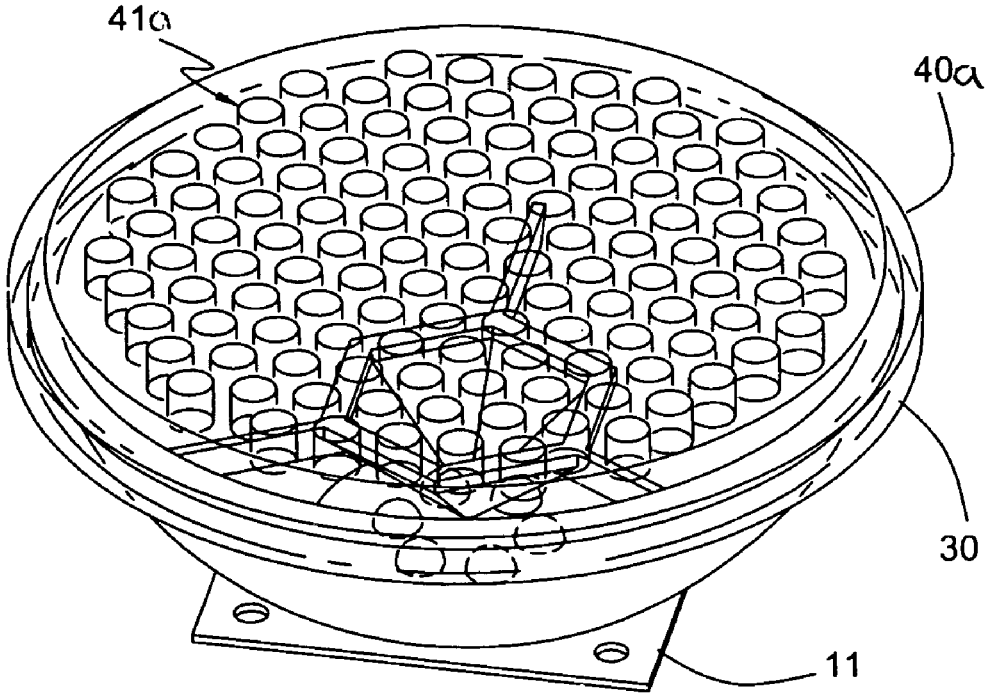
FIG. 4 is a perspective view of a focused lighting device according to a second embodiment of the present invention.
Figure 5:
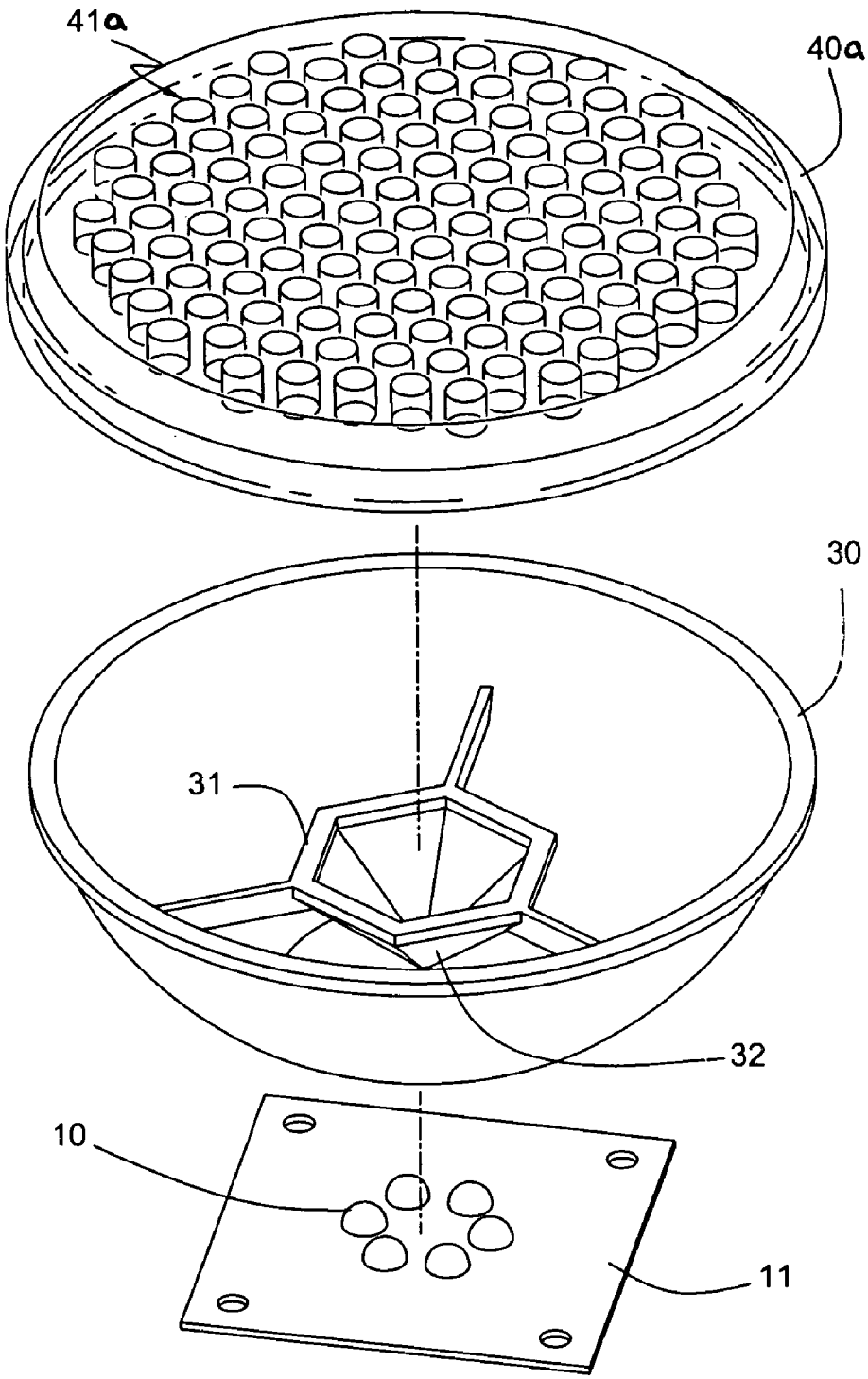
FIG. 5 is an exploded perspective view of the focused lighting device of FIG. 4.

FIGS. 4-5 illustrate a focused lighting device according to a second embodiment of the present invention. As with the first embodiment, the focused lighting device also has a hood body 40*a*, a focusing cup 30 and a plurality light sources 10, with the cup 30, the reflective hood 31, the reflective mirrors 32, and the light sources 10 being the same as the corresponding elements in the first embodiment. In particular, the hood body 40*a* is disposed at the top opening of the focusing cup 30. The cup 30 also has a convex-like cup shape. A reflective hood 31 is centered at the bottom of the focusing cup 30. The reflective hood 31 has a plurality of reflective mirrors 32 arranged in a ring-like or polygonal arrangement, and angled with respect to the horizontal plane, so that the bottom of the reflective hood 31 forms an apex. Each reflective mirror 32 is adapted to reflect a light beam emitted from one of the light sources 10, and each reflective mirror 32 is angled with respect to the light beam emitted from its corresponding light source 10 such that each respective light beam emitted from the respective light sources 10 can be reflected to the cup 30 via the corresponding reflective mirrors 32, thereby allowing the light sources 10 to simulate a central light source focused in the focusing cup 30. As described earlier, the reflective mirrors 32 can have a planar or curved surface to achieve different simulation results.

Figure 6:
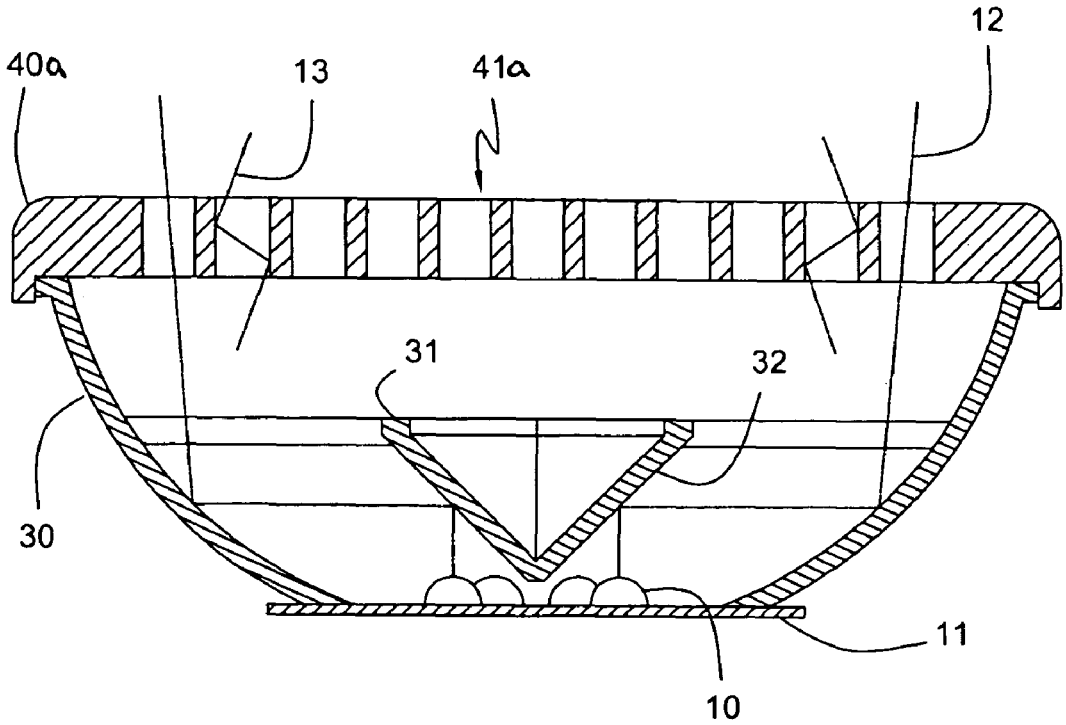
FIG. 6 is a cross-sectional view of the focused lighting device of FIG. 4.

Referring also to FIG. 6, the hood body 40*a* is provided with a plurality of parallel light guides 41*a* such that the main light beams within a predetermined angle with respect to the wall of the plurality of parallel light guides 41 can be directly projected out, and the remaining stray light beams 13 (i.e., the light beams other than the main light beams) can be scattered or reduced through the walls of the light guides 41*a*. The light guides 41*a* can be an array of a plurality of parallel circular hollow columns directly penetrated and formed integrally (i.e., in one piece) with the hood body 40*a*. The hood body 40*a* can be made of materials with light-absorbing (e.g., dark materials) or light-scattering (e.g., light color or translucent material) characteristics, so as to achieve the effects of absorbing, scattering, or homogenizing stray light beams 13 other than the main light beams.

Figure 7:
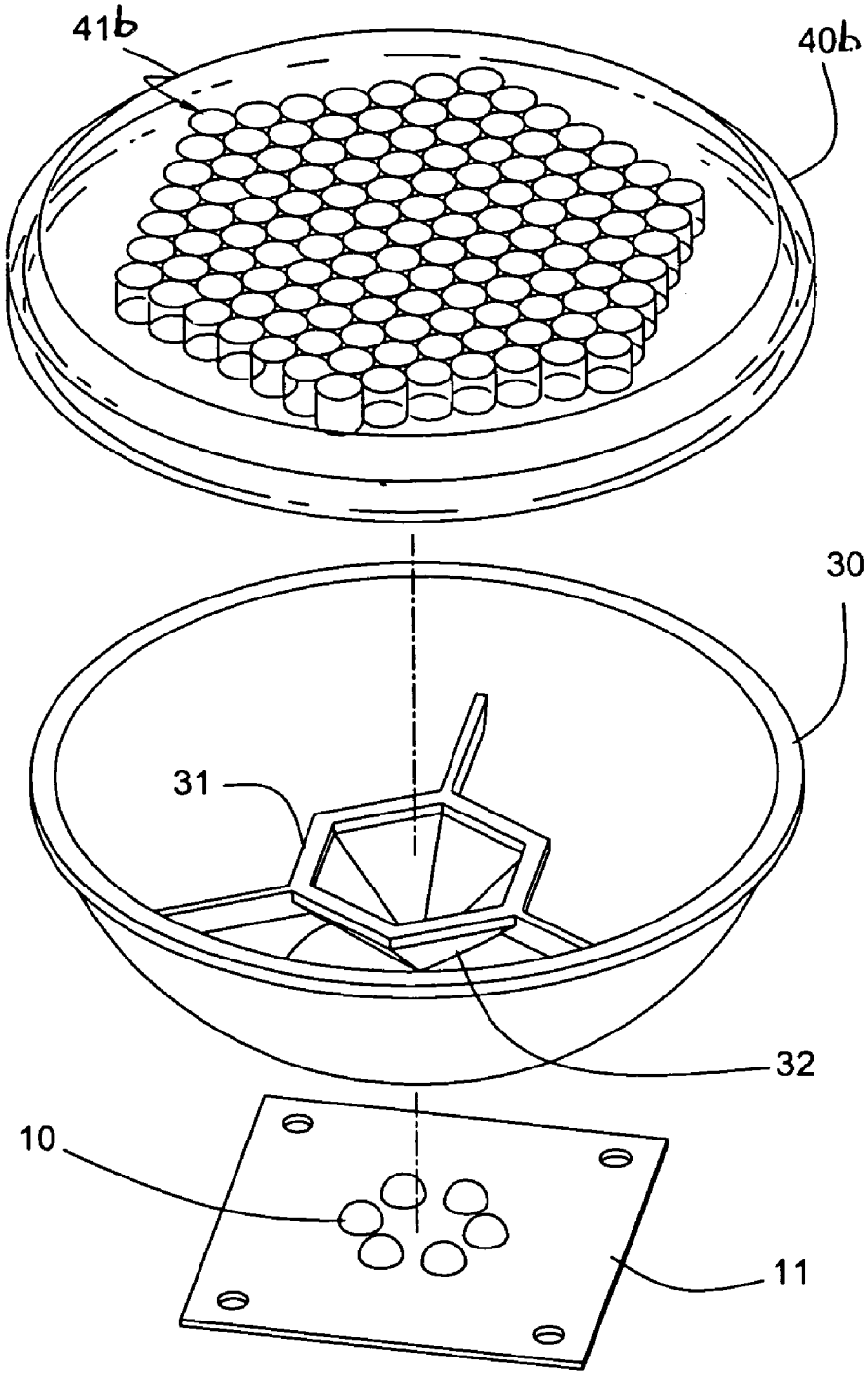
FIG. 7 is an exploded perspective view of a focused lighting device according to a third embodiment of the present invention.
Figure 8A:
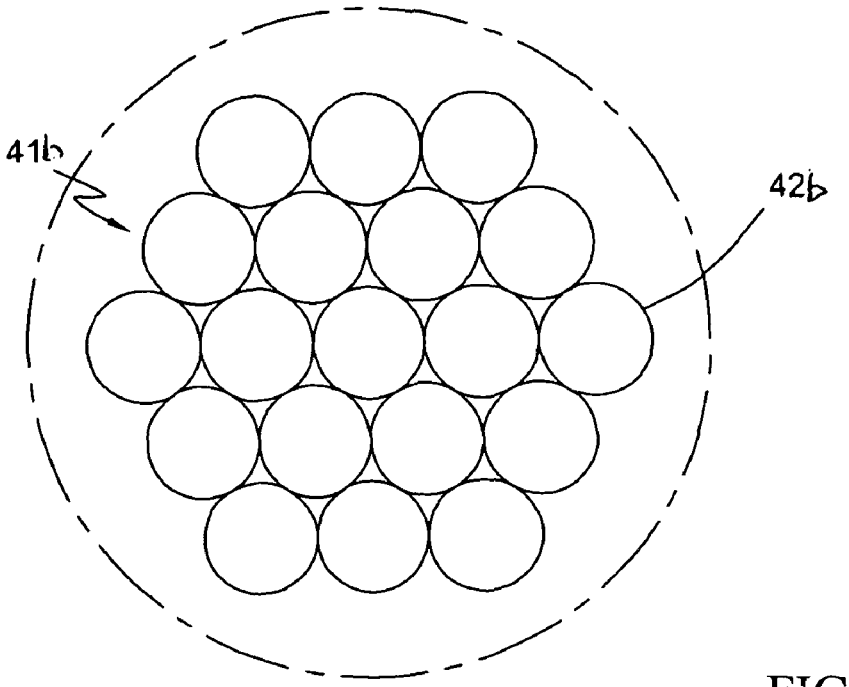
FIGS. 8A-8C are partial close-up views of different light guides of the focused lighting device of FIG. 7.
Figure 8B:
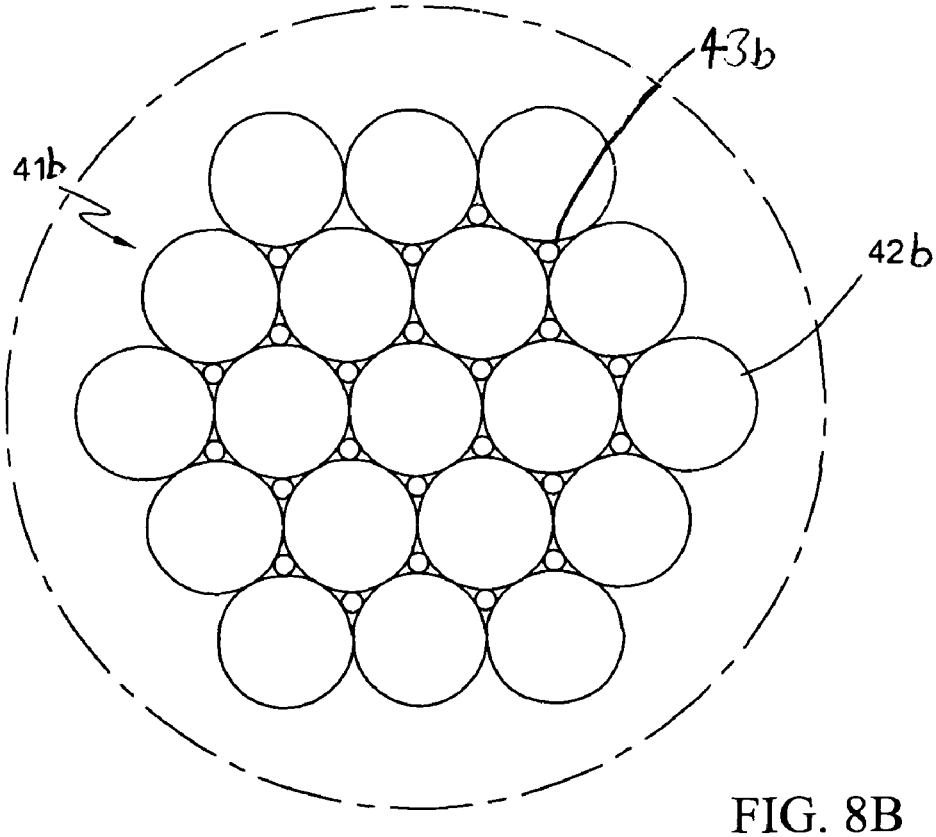
Figure 8C:
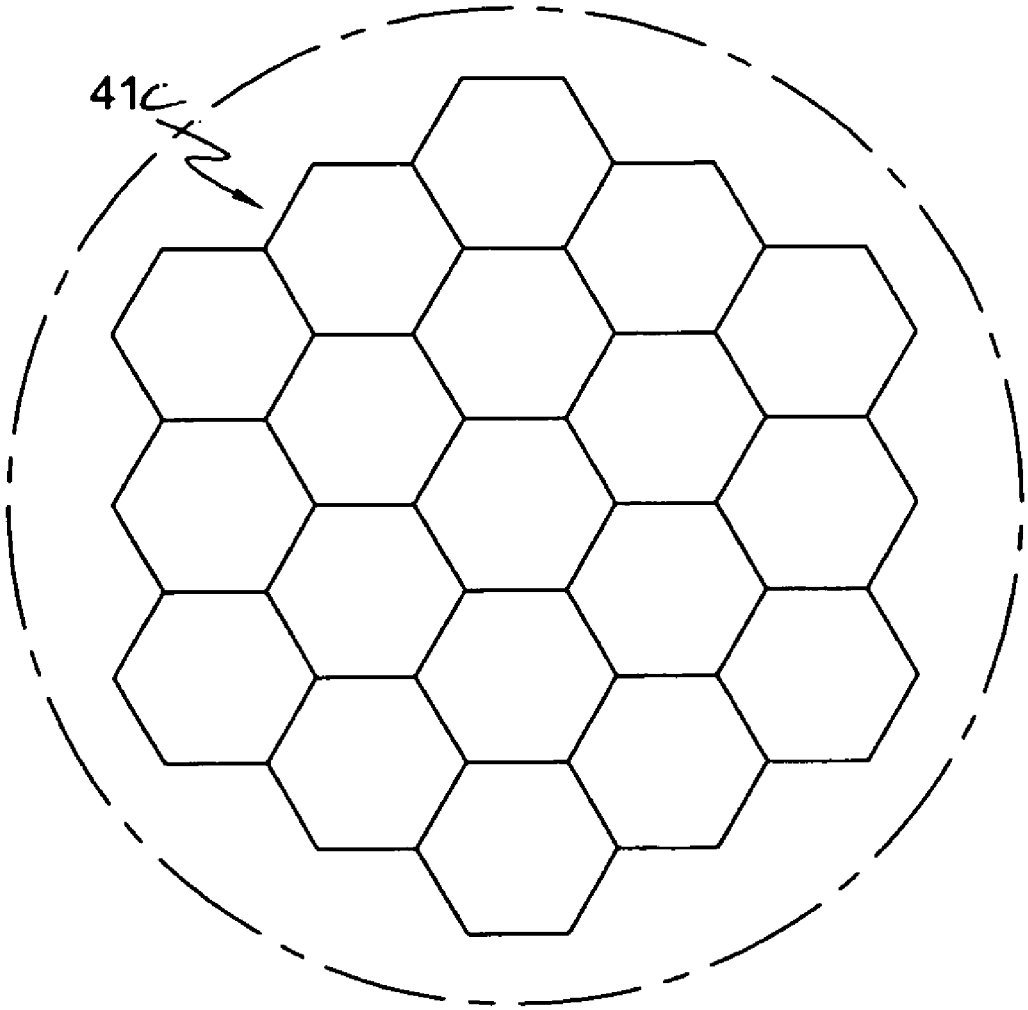

FIG. 7 illustrates a focused lighting device according to a third embodiment of the present invention. In addition to the embodiments described above, the light guide 41*b* in FIG. 7 can also include a plurality of adjoining glass columns or acrylic columns 42*b* which are secured adhesively and arranged in a dense fashion (see FIG. 8A). The walls of the glass columns or acrylic columns 42*b* may be surface treated to have absorbing or scattering characteristics. For example, the walls of the glass columns or acrylic columns 42*b* may be coated with light absorbing materials and the plurality of the glass columns or acrylic columns 42*b* may be adhesively connected to form the light guides 41*b* with light absorbing characteristics. Further, the cross-section of the glass columns or acrylic columns 42*b* is generally circular, so that smaller glass columns or acrylic columns 43*b* may be inserted between the glass columns or acrylic columns 42*b* (see FIG. 8B) to have a denser configuration so as to enhance the light perviousness of the light guides 41*b*. In addition to the circular cross-section for the light guide 41*b*, the light guides 41*b* may also be designed to have a hexagonal cross-section, which can further reduce the gaps between the columns, as shown in FIG. 8C. The cup 30, the reflective hood 31, the reflective mirrors 32, and the light sources 10 in FIGS. 7 and 8 can be the same as the corresponding elements in the first embodiment.

While the description above refers to particular embodiments of the present invention, it will be understood that many modifications may be made without departing from the spirit thereof.

What is claimed is:

1. A focused lighting device comprising:

a plurality of light sources, each of which emits a light beam;

a focusing cup having a cup body with an opening at its top, a reflective hood positioned in the cup body and defining a plurality of reflective mirrors, with each mirror corresponding to a separate one of the light beams emitted from the light sources to reflect the corresponding light beam emitted from the light sources, so as to simulate a central light source focused in the focused cup; and a plurality of partitions, with each partition positioned between adjacent reflective mirrors to separate the light beams emitted from the light sources so as to prevent the light beams from projecting onto non-corresponding reflective mirrors.

2. A focused lighting device as claimed in claim 1, wherein the light sources are arranged in a ring shape in the focusing cup.

3. A focused lighting device as claimed in claim 1, wherein the light sources are arranged in a polygonal shape in the focusing cup.

4. A focused lighting device as claimed in claim 1, wherein the partitions are made of materials with light-absorbing characteristics so as to absorb the light beams projected on the partitions.

5. A focused lighting device as claimed in claim 1, wherein the partitions are made of materials with light-scattering characteristics so as to scatter and homogenize the light beams projected on the partitions.

6. A focused lighting device as claimed in claim 1, wherein the light sources are light beams emitted diodes (LEDs).

7. A focused lighting device as claimed in claim 1, wherein each of the reflective mirrors has a planar or curved surface.

8. A focused lighting device as claimed in claim 1, further comprising a hood body disposed at the opening of the focusing cup.

9. A focused lighting device as claimed in claim 1, wherein the light sources are arranged at different levels.

10. A focused lighting device comprising:

a plurality of light sources, each of which emits a light beam;

a focusing cup having a cup body with an opening at its top, a reflective hood positioned in the cup body and defining a plurality of reflective mirrors, with each mirror corresponding to a separate one of the light beams emitted from the light sources to reflect the corresponding light beam emitted from the light sources, so as to simulate a central light source focused in the focused cup; and a hood body disposed at the top opening of the focusing cup and having a plurality of parallel light guides such that the light beams emitted from predetermined angles with respect to the light guides are projected directly through the light guides, and the light beams emitted from other angles with respect to the light guides are reduced or scattered by the walls of the light guides.

11. A focused lighting device as claimed in claim 10, wherein the light sources are arranged in a ring or polygonal shape in the focusing cup.

12. A focused lighting device as claimed in claim 10, wherein the light sources are arranged in a polygonal shape in the focusing cup.

13. A focused lighting device as claimed in claim 10, wherein the light guides are hollow columns penetrating the hood body.

14. A focused lighting device as claimed in claim 10, wherein the hood body around the light guides are made of materials with light-absorbing characteristics.

15. A focused lighting device as claimed in claim 10, wherein the hood body around the light guides are made of materials with light-scattering characteristics.

16. A focused lighting device as claimed in claim 10, wherein the light guides are glass columns or acrylic columns.

17. A focused lighting device as claimed in claim 10, wherein the cross-section of the light guides are circular or hexagonal.

18. A focused lighting device as claimed in claim 10, wherein the cross-sectional sizes of the light guides are different.

19. A focused lighting device as claimed in claim 10, wherein the light sources are light beams emitted diodes (LEDs).

20. A focused lighting device as claimed in claim 10, wherein each reflective mirrors has a planar or curved surface.

* * * * *